US005273265A

United States Patent [19]

Edwards

[11] Patent Number: 5,273,265

[45] Date of Patent: Dec. 28, 1993

[54] ADJUSTABLE OVER/UNDER GUIDE PLATE FOR SHEET FEEDER

[75] Inventor: Robert J. Edwards, Ridgefield, Conn.

[73] Assignee: Pitney Bowes Inc., Stamford, Conn.

[21] Appl. No.: 992,311

[22] Filed: Dec. 21, 1993

[51] Int. Cl.[5] ..... B65H 43/00

[52] U.S. Cl. ..... 270/59; 270/58

[58] Field of Search ..... 270/58, 59

[56] References Cited

U.S. PATENT DOCUMENTS

| | | | |
|---|---|---|---|
| 2,975,576 | 3/1961 | Garapolo | 270/58 X |
| 4,169,341 | 10/1979 | Roetter et al. . | |
| 4,266,761 | 5/1981 | Buck | 270/58 |
| 4,548,393 | 10/1985 | Irvine et al. . | |
| 4,753,429 | 6/1988 | Irvine et al. . | |

*Primary Examiner*—Edward K. Look
*Assistant Examiner*—John Ryznic
*Attorney, Agent, or Firm*—Charles R. Malandra, Jr.; Melvin J. Scolnick

[57] ABSTRACT

In a document collating and stuffing apparatus wherein documents are collated along a longitudinally extending transport deck having an upstream end and a downstream end, the documents being fed from a plurality of feeding stations serially positioned above the transport deck, and at least one of the feeding stations including a platform mounted thereto, an improvement to the feeding station comprising structure for adjustably positioning the platform at one of a raised position and a lowered position, the raised position causing the feed station to feed the documents directly to the transport deck before a next upstream collation is transported on top of the fed document by pusher structure, and the lowered position causing the platform to support documents fed thereto until the next upstream collation is transported along the transport deck under the platform by the pusher structure at which time the document is transported on top of the collation by the pusher structure.

3 Claims, 5 Drawing Sheets

ADJUSTABLE OVER/UNDER GUIDE PLATE FOR SHEET FEEDER

FIELD OF THE INVENTION

The invention disclosed herein relates to generally document feeding apparatus in machines collating different kinds of documents, and more particularly to document feeders in inserting machines.

BACKGROUND OF THE INVENTION

In large volume collating and inserting machines of the type having a series of document feeding stations located above a document transport path, it is well known to feed and collect the documents from some or all of the document feeding stations while collating the same. An envelope stuffing apparatus is located downstream from the feeding stations for stuffing the collated documents into an envelope.

At one time such collating and inserting machines operated on an interrupted basis wherein the collection of documents at the respective feeding stations required the conveying mechanism to come to a full stop. See, for example, U.S. Pat. Nos. 3,049,845, 3,965,644 and 3,934,867. More recently, it is well known that collations can be formed with continuous operation of the conveying mechanism and intermittent operation of the respective feeding stations. See, for example, U.S. Pat. Nos. 4,169,341 and 4,753,429.

Generally, an inserting machine is dedicated for use in forming either a "top down" collation, i.e., documents are fed to the top of a collation conveyed past a feeding station, or a "bottom up" collation, i.e., documents are fed to the transport path and the collation is conveyed onto the document. An example of a "top down" collation is shown in U.S. Pat. No. 4,169,341. An example of a "bottom up" collation is shown in U.S. Pat. No. 4,548,393.

An essential difference between the feeders feeding to form "top down" collations and feeders feeding to form "bottom down" collations is that each of the former feeders include a platform to which documents are fed until the documents are ready to be conveyed onto a collation being conveyed under the platform. The platform is mounted to the downstream end of the feeder above the transport path so that the document fed by the feeder is supported by the platform above a transport path until a transport mechanism, typically chain driven pushers, conveying a downstream collation engages the document on the platform causing the document to be lowered onto the collation as the collation is transported past the platform. Typically, feeders feeding to form "bottom up" collations do not include a platform because they feed documents directly to the transport deck whereby downstream collations are conveyed on top of the documents.

In some instances, an inserting machine must be converted from assembling "top down" collations to "bottom up" collations, or vice versa. When such a conversion is necessary, a service technician is generally needed to reconfigure the machine. Typically, the platform must be added to the feeding station if "top down" collations are desired, or removed from the feeding station if "bottom up" collations are desired. Such reconfigurations typically include removal of the feeding stations to add or remove the platform, and adjustment of the feeding stations after the platform has been added or removed.

It is an object of the present invention to simplify the conversion of the feeders to feed to "top down" and "bottom up" collations.

It is a further object of the present invention to provide an improved platform guide that does not require removal of the feeding station to change between "top down" and "bottom up" collations.

It is a further object of the present invention to provide an improved platform guide which does not require a service technician adjustment.

SUMMARY OF THE INVENTION

It has been found that the present invention simplifies the conversion of feed stations in an inserting machine for feeding to assemble either "top down" or "bottom up" collations by eliminating the need for removal of the feed station. Thus, the present invention provides a universal feed station for feeding to either type of collation by means of a simple operator adjustment.

In accordance with the present invention, for a document collating and stuffing apparatus wherein documents are collated along a longitudinally extending transport deck having an upstream end and a downstream end, the documents being fed from a plurality of feeding stations serially positioned above the transport deck, and at least one of the feeding stations including a platform mounted thereto, an improvement to the feeding station comprising structure for adjustably positioning the platform at one of a raised position and a lowered position, the raised position causing the feed station to feed the documents directly to the transport deck before a next upstream collation is transported on top of the fed document by pusher structure, and the lowered position causing the platform to support documents fed thereto until the next upstream collation is transported along the transport deck under the platform by the pusher structure at which time the document is transported on top of the collation by the pusher structure.

DETAILED DESCRIPTION OF THE PRESENT INVENTION

Figure 1:
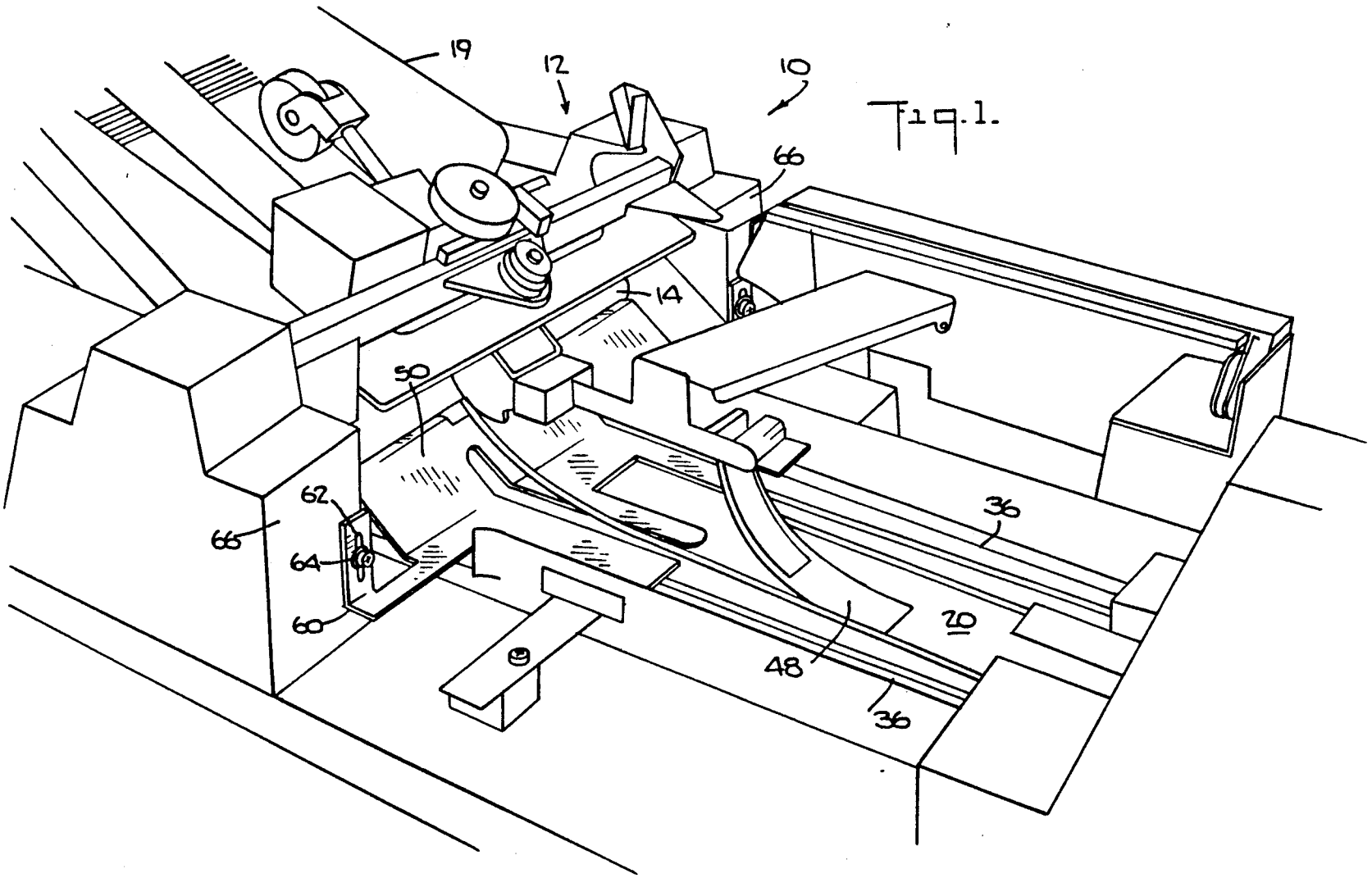
FIG. 1 is a perspective view of a document feeder and guide plate assembly and pusher transport in accordance with the present invention.
Figure 2:
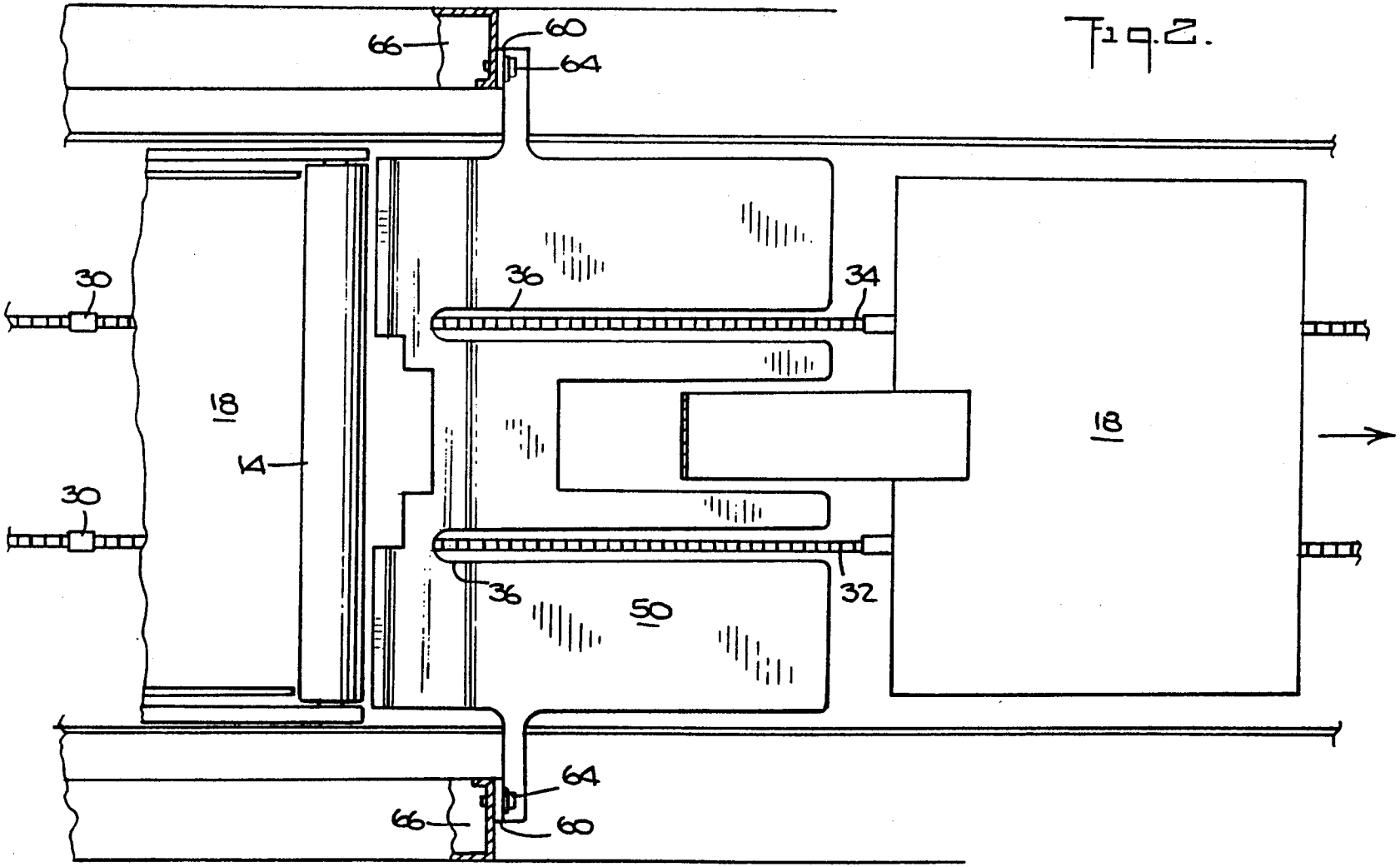
FIG. 2 is a top view of the feeder and guide plate assembly and the pusher transport of FIG. 1.

In describing the present invention, reference is made to the drawings, wherein there is seen an feed station of an inserting machine, generally designated 10, having a feeder, generally designated 12, which includes a pair of feeder exit rollers 14 and 16 for feeding a document 18 from a hopper 19 located upstream feeder exit rollers 14 and 16. Situated below feeder 12 is a longitudinally extending transport deck 20, which, as best seen in FIGS. 6–9, steps down in the direction of transport (indicated by the arrows in FIGS. 6–9) under feeder 12. Typically, feed station 10 is one of several succeeding feed stations that are similarly configured, e.g., feed station 11 is the next upstream feed station to feed station 10 (FIGS. 6–9).

Situated below transport deck 20 is a conventional chain and sprocket transport system including a plurality of pushers 30, such as the transport system described in U.S. Pat. No. 4,169,341, incorporated herein by reference. The transport system includes a pair of endless chains 32 and 34 which are trained about sprockets (not shown). Chains 32 and 34 are received within longitudinal openings 36 in deck 20. Each of chains 32 and 34 has a plurality of pushers 30 extending outwardly therefrom. Pushers 30 assume a position generally normal to the direction of travel of chains 32 and 34 when located within the openings 36 of deck 20.

Figure 5:
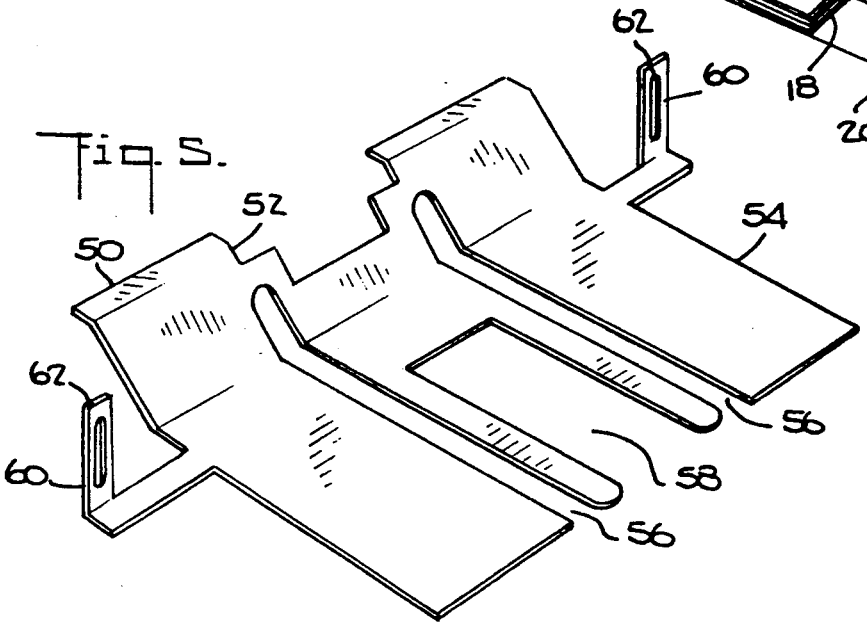
FIG. 5 is a perspective view of the guide plate in FIG. 1.

In accordance with the present invention, feed station 12 includes a guide plate in the form of an adjustable feeder platform 50 which is capable of supporting documents that are fed from hopper 19 of feeder 12. Referring now to FIG. 5, the structure of platform 50 includes an upstream sloped portion 52 for receiving documents fed from rollers 14 and 16, and a downstream level portion 54 for supporting such fed documents 18. The length of level portion 54 is at least as long as the length of the documents being fed from hopper 19. In the preferred embodiment, the length of level portion 54 is either 5 or 6 inches for typical enclosures to be fed from hopper 19.

Platform 50 further includes two longitudinal slots 56 corresponding to longitudinally openings 36 in deck 20. There is a center slot 58 for accommodating a conventional guide strap 48 (FIG. 1) which provides a suitable biased force against deck 20 to maintain the collation integrity of collations passing there between. It will be understood that devices, such as a guide brush)could be accommodated as well.

There are a pair of arm members 60, one on each side of platform 50 at approximately where the sloped portion 52 meets the level portion 54. Each arm members 60 includes a slotted section with a slot 62, which is orthogonal to level portion 54. Platform 50 is mounted to feeder 12 via screws 64 fastened to frame member 66 of feeder 12 through slots 62. Platform 50 can be moved to a raised or lowered position by loosening screws 64, adjusting platform 50 to the desired height, and then tightening screws 64. In this manner, an operator can perform the adjustment.

Figure 3:
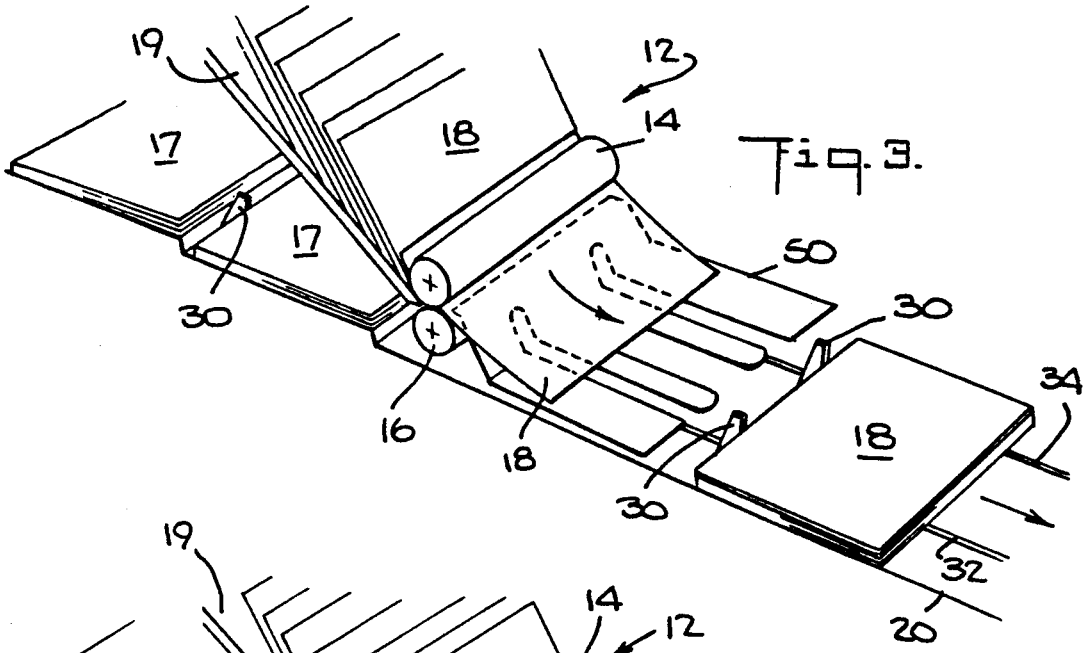
FIG. 3 is a partial perspective view of the feeder and guide plate assembly and pusher transport of FIG. 1 with the guide plate assembly in a lowered position for feeding documents to the top of a passing collation.
Figure 6:
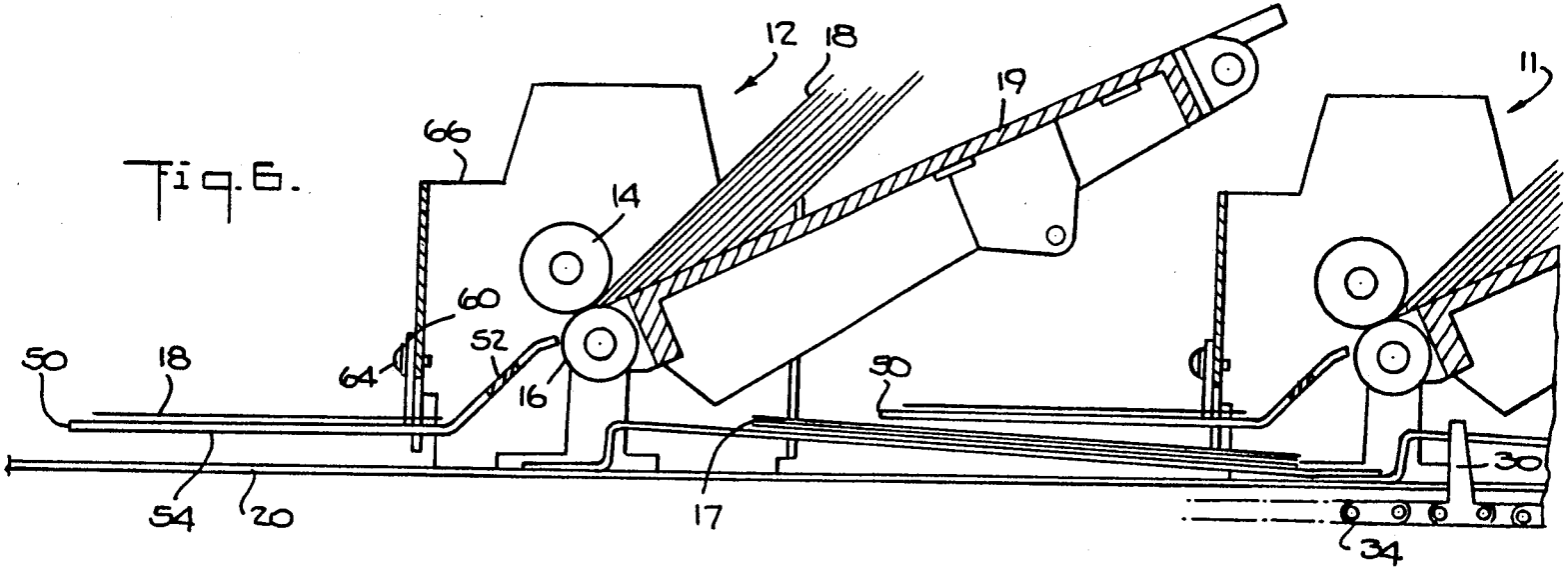
FIG. 6 is a side view of the feeder and guide plate assembly of FIG. 3, showing a document on the guide plate waiting for an upstream collation to be conveyed thereunder.
Figure 7:
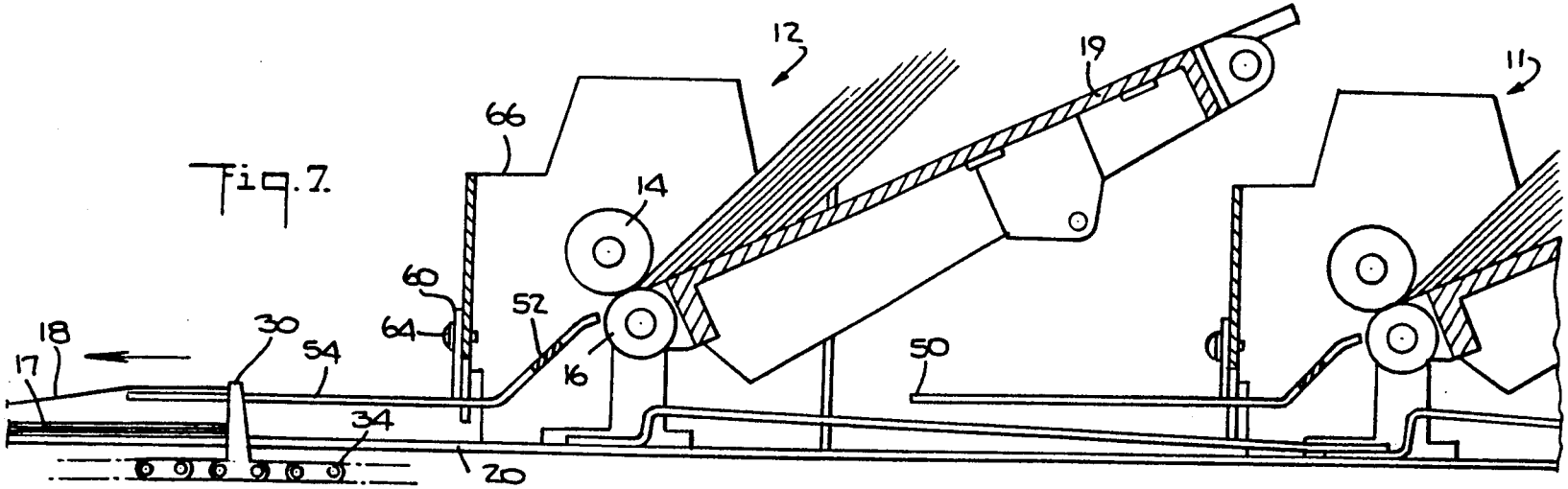
FIG. 7 is a side view of the feeder and guide plate assembly as in FIG. 6, showing the document being transported from the guide plate onto the passing collation.

In operation, when the inserting machine is assembling "top down" collations, the operator loosens screws 64 and lowers platform 50 to a position indicated in FIGS. 3, 6 and 7. The upstream edge of sloped portion 52 is slightly below the nip of rollers 14 and 16 for receiving documents 18 fed therethrough. The operator then tightens screws 64 to lock platform 50 in place. As a document 18 is fed by feed rollers 14 and 16, document 18 is supported by level portion 54 until pushers 30, which are transporting collation 17 along transport deck 20, engage the upstream edge of document 18 and push document 18 onto collation 17 and transport the collation, with document 18 added thereto, downstream for further processing (FIGS. 6 and 7). The cycle is repeated for each document 18 fed from feeder 12. Pushers 30 engage document 18 on platform 50 through slots 56.

Figure 4:
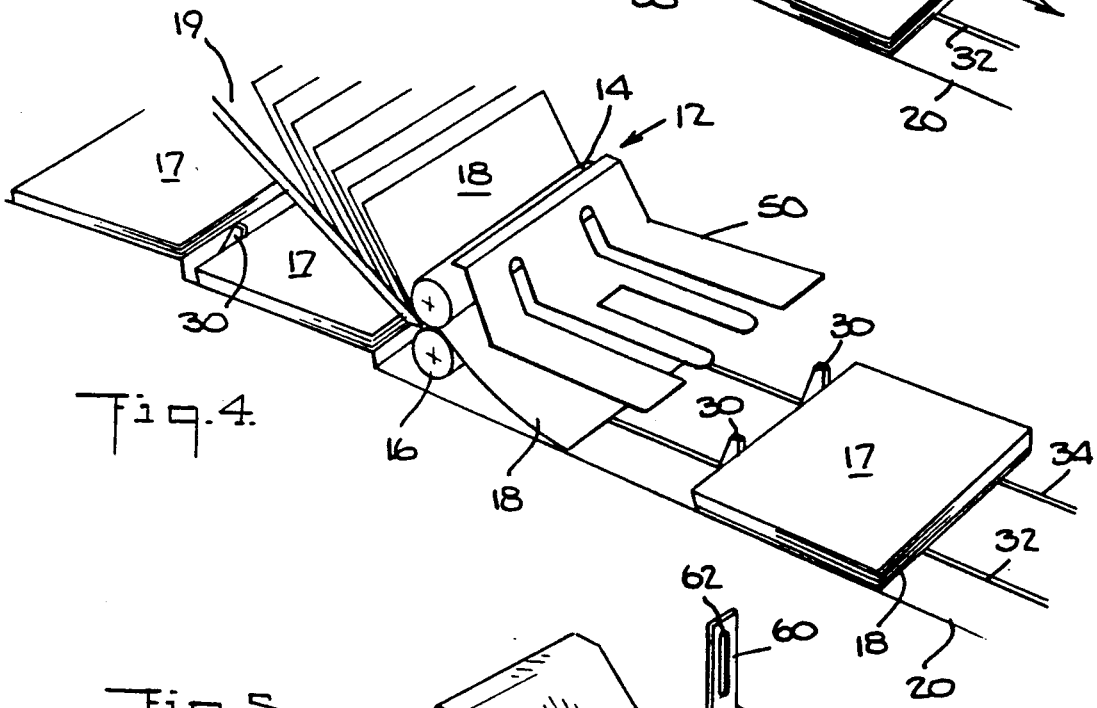
FIG. 4 is a partial perspective view of the feeder and guide plate assembly and pusher transport of FIG. 1 with the guide plate assembly in a raised position for feeding documents to the bottom of a passing collation.
Figure 8:
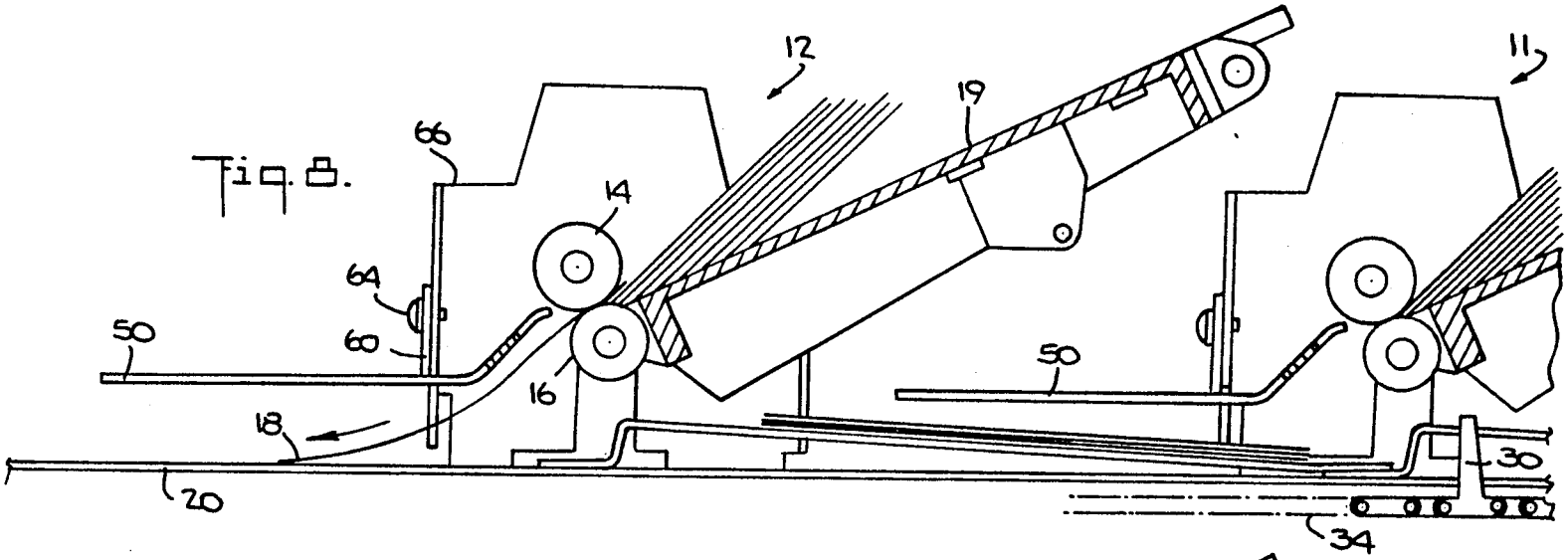
FIG. 8 is a side view of the feeder and guide plate assembly of FIG. 4, showing a document being fed onto a transport deck.
Figure 9:
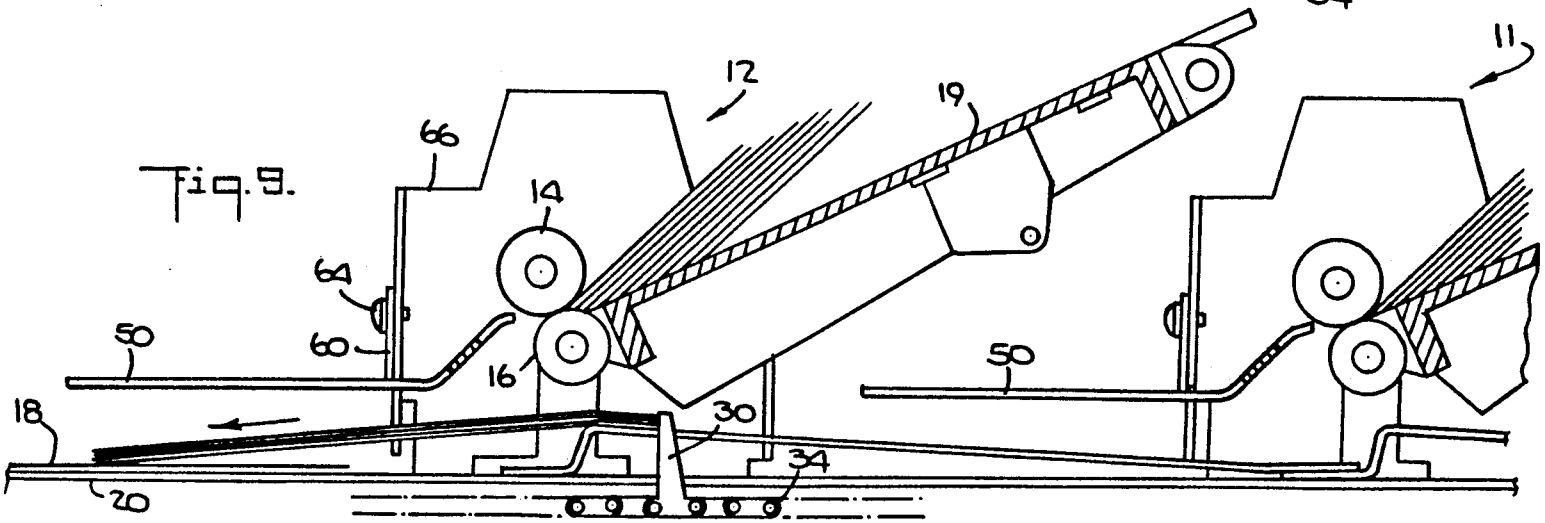
FIG. 9 is a side view of the feeder and guide plate assembly as in FIG. 8, showing the collation being transported on top of the fed document.

When the inserting machine is assembling "bottom up" collations, the operator loosens screws 64 and raises platform 50 to a position indicated in FIGS. 4, 8 and 9. The sloped portion 52 is entirely above the path of documents 18 fed from feed rollers 14 and 16 so that documents 18 are fed directly to transport deck 20 (FIGS. 8 and 9). Thus, collation 17 is transported along transport deck 20 and onto document 18 by pushers 30. It is well known to use a raised section of transport deck 20 under feeder 12 to accomplish this.

While the present invention has been disclosed and described with reference to a single embodiment thereof, it will be apparent, as noted above that variations and modifications may be made therein. It is, thus, intended in the following claims to cover each variation and modification that falls within the true spirit and scope of the present invention.

What is claimed is:

1. In a document collating and stuffing apparatus wherein documents are collated along a longitudinally extending transport deck having an upstream end and a downstream end, the documents being fed from a plurality of feeding stations serially positioned above the transport deck, and at least one of the feeding stations including a platform mounted thereto, an improvement to the feeding station comprising means for adjustably positioning the platform at one of a raised position and a lowered position, said raised position causing the feed station to feed the documents directly to the transport deck before a next upstream collation is transported on top of the fed document by pusher means, and the lowered position causing the platform to support documents fed thereto until the next upstream collation is transported along the transport deck under the platform by the pusher means at which time the document is transported on top of the collation by the pusher means.

2. The improvement of claim 1 wherein said adjustable positioning means includes a slotted bracket member situated at each side of the platform, the platform being adjustably mounted to a frame member of the feeding station by fastening the platform to the frame member through said slotted bracket.

3. A method of adjustably mounting a platform to the downstream end of a feed station, comprising the steps of:

providing the platform with a pair of slotted bracket members;

positioning the platform in a desired one of raised and lowered positions above a transport deck along which documents are ultimately transported; and securing said slotted bracket members to frame members of the feed station by a screw through each of said slotted bracket members.

* * * * *